US008454334B2

(12) United States Patent
Heger et al.

(10) Patent No.: US 8,454,334 B2
(45) Date of Patent: Jun. 4, 2013

(54) LUBRICANT CONTROL VALVE FOR A SCREW COMPRESSOR

(75) Inventors: Joseph Heger, West Salem, WI (US); Robert Mayfield, Pueblo West, CO (US)

(73) Assignee: Trane International Inc., Piscataway, NJ (US)

( * ) Notice: Subject to any disclaimer, the term of this patent is extended or adjusted under 35 U.S.C. 154(b) by 232 days.

(21) Appl. No.: 13/024,356

(22) Filed: Feb. 10, 2011

(65) Prior Publication Data

US 2012/0207634 A1 Aug. 16, 2012

(51) Int. Cl.

| | |
|---|---|
| ***F01C 21/04*** | (2006.01) |
| ***F01C 1/16*** | (2006.01) |
| ***F04C 29/02*** | (2006.01) |
| ***F04C 2/16*** | (2006.01) |
| ***F04C 18/18*** | (2006.01) |

(52) U.S. Cl.

USPC ..... 418/84; 418/83; 418/87; 418/97; 418/99; 418/201.1; 418/201.2; 418/206.8

(58) Field of Classification Search

USPC ..... 418/84, 83, 87, 97, 98, 99, 100, 201.2, 418/201.1, 205, 206.8

See application file for complete search history.

(56) References Cited

U.S. PATENT DOCUMENTS

| | | | | |
|---|---|---|---|---|
| 4,519,748 | A * | 5/1985 | Murphy et al. | 418/201.2 |
| RE32,055 | E | 12/1985 | Schibbye et al. | |
| 4,609,329 | A * | 9/1986 | Pillis et al. | 418/201.2 |
| 4,842,501 | A * | 6/1989 | Schibbye et al. | 418/201.2 |
| 4,995,797 | A | 2/1991 | Tsuboi | |
| 5,626,470 | A * | 5/1997 | Gerhardt | 418/84 |
| 5,957,676 | A | 9/1999 | Peeters | |
| 6,826,926 | B2 | 12/2004 | Rousseau et al. | |
| 7,094,037 | B2 | 8/2006 | Nakamura et al. | |
| 7,588,430 | B2 * | 9/2009 | Hasegawa | 418/201.1 |
| 2010/0205952 | A1 | 8/2010 | Yamamuro et al. | |

FOREIGN PATENT DOCUMENTS

| | | |
|---|---|---|
| JP | 63176689 | 7/1988 |

OTHER PUBLICATIONS

International Search Report and Written Opinion for Application No. PCT/US2012/024241 dated Aug. 24, 2012 (6 pages).

* cited by examiner

*Primary Examiner* — Mary A Davis
(74) *Attorney, Agent, or Firm* — Michael Best & Friedrich LLP

(57) ABSTRACT

A compressor system includes a lubricant reservoir, a screw compressor, and a valve. The screw compressor includes a housing defining a compression chamber having a suction port, a discharge port, a first lubricant feed port located between the suction port and the discharge port, and a second lubricant feed port located between the discharge port and the first lubricant feed port. The valve is in fluid communication with the lubricant reservoir, the first lubricant feed port via a first lubricant feed passageway, and the second lubricant feed port via a second lubricant feed passageway. The valve is movable between a first position and a second position. In the first position, the valve fluidly connects the lubricant reservoir to the first lubricant feed passageway to direct lubricant to the first lubricant feed port. In the second position, the valve fluidly connects the lubricant reservoir to the second lubricant feed passageway to direct lubricant to the second lubricant feed port.

20 Claims, 10 Drawing Sheets

LUBRICANT CONTROL VALVE FOR A SCREW COMPRESSOR

BACKGROUND

The present invention relates to screw compressors and, more particularly, to valves for screw compressors.

Screw compressors often include oil injection systems for injecting oil into compression chambers and bearings of the compressors. The oil injection systems provide lubrication, cooling, and improved sealing within the compression chambers. Oil injection systems often use refrigeration system pressures, including compressed fluid pressures and oil pressures, to inject the oil into the compression chambers and the bearings of the compressors. For example, oil may be injected as a result of the pressure difference between the system discharge pressure and the pressure at the injection port. Oil is typically not injected during operating states where the system pressure is equal to or less than the pressure at the injection port.

To improve compressor efficiency, it is sometimes desirable to inject oil into the compression chamber at an injection port that is close to the discharge port of the compressor. However, one disadvantage of locating the injection port near the discharge port of the compressor is that relatively high pressures in the compression chamber may prevent oil from being injected when the oil pressure is relatively low. As such, many current oil injection systems locate the injection port closer to the suction port of the compressor, sacrificing efficiency in order to reduce the possibility of no oil being injected into the compression chamber.

SUMMARY

In one embodiment, the invention provides a compressor system including a lubricant reservoir adapted to contain a lubricant and a screw compressor. The screw compressor includes a housing defining a compression chamber having a suction port, a discharge port, a first lubricant feed port located between the suction port and the discharge port, and a second lubricant feed port located between the discharge port and the first lubricant feed port. The screw compressor also includes a drive rotor supported by the housing and disposed within the compression chamber and an idler rotor supported by the housing and disposed within the compression chamber. The idler rotor is driven by the drive rotor to compress and move fluid in a direction of increasing pressure from the suction port to the discharge port creating a pressure at a first pressure region. The compressor system also includes a valve in fluid communication with the lubricant reservoir, the first lubricant feed port via a first lubricant feed passageway, and the second lubricant feed port via a second lubricant feed passageway. The valve is movable between a first position and a second position based on the pressure at the first pressure region. In the first position, the valve fluidly connects the lubricant reservoir to the first lubricant feed passageway to direct lubricant to the first lubricant feed port. In the second position, the valve fluidly connects the lubricant reservoir to the second lubricant feed passageway to direct lubricant to the second lubricant feed port.

In another embodiment, the invention provides a method of operating a compressor system. The compressor system includes a lubricant reservoir adapted to contain a lubricant and a screw compressor. The screw compressor includes a housing defining a compression chamber having a suction port, a discharge port, a first lubricant feed port located between the suction port and the discharge port, and a second lubricant feed port located between the discharge port and the first lubricant feed port. The method includes providing a valve in fluid communication with the lubricant reservoir, the first lubricant feed port via a first lubricant feed passageway, and the second lubricant feed port via a second lubricant feed passageway. The method also includes compressing and moving fluid in a direction of increasing pressure from the suction port to the discharge port creating a pressure at a first pressure region, moving the valve between a first position and a second position based on the pressure at the first pressure region, fluidly connecting the lubricant reservoir to the first lubricant feed passageway when the valve is in the first position to direct lubricant to the first lubricant feed port of the screw compressor, and fluidly connecting the lubricant reservoir to the second lubricant feed passageway when the valve is in the second position to direct lubricant to the second lubricant feed port of the screw compressor.

These and other aspects of various embodiments of the invention, together with the organization and operation thereof, will become apparent from the following detailed description when taken in conjunction with the accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of illustration and description of one or more examples of the invention and should not be regarded as limiting. It is possible that the invention could be embodied in forms not specifically described herein.

Figure 1:
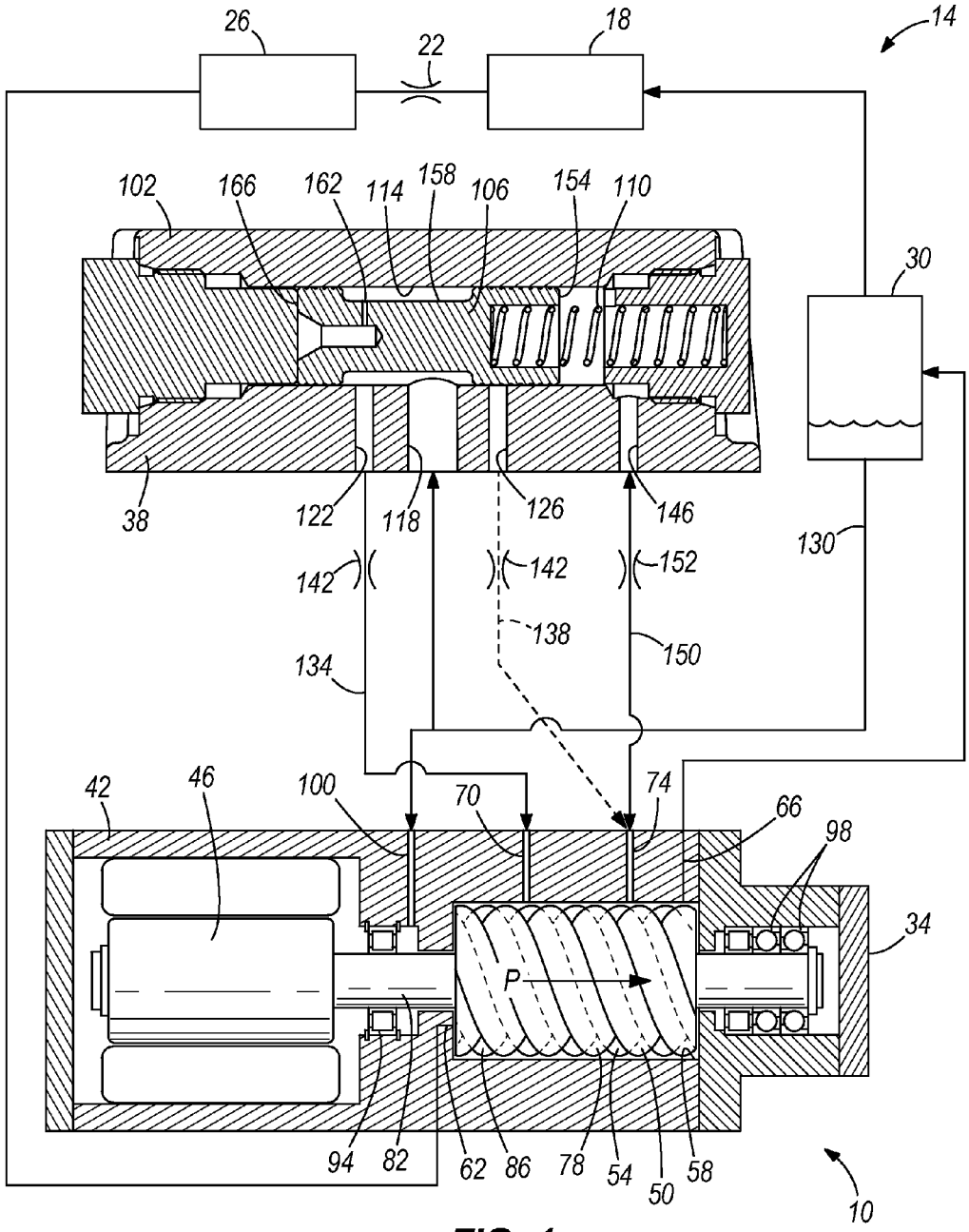
FIG. 1 is a schematic of a refrigeration system including a compressor system embodying aspects of the invention, the compressor system including a valve in a first position.
Figure 2:
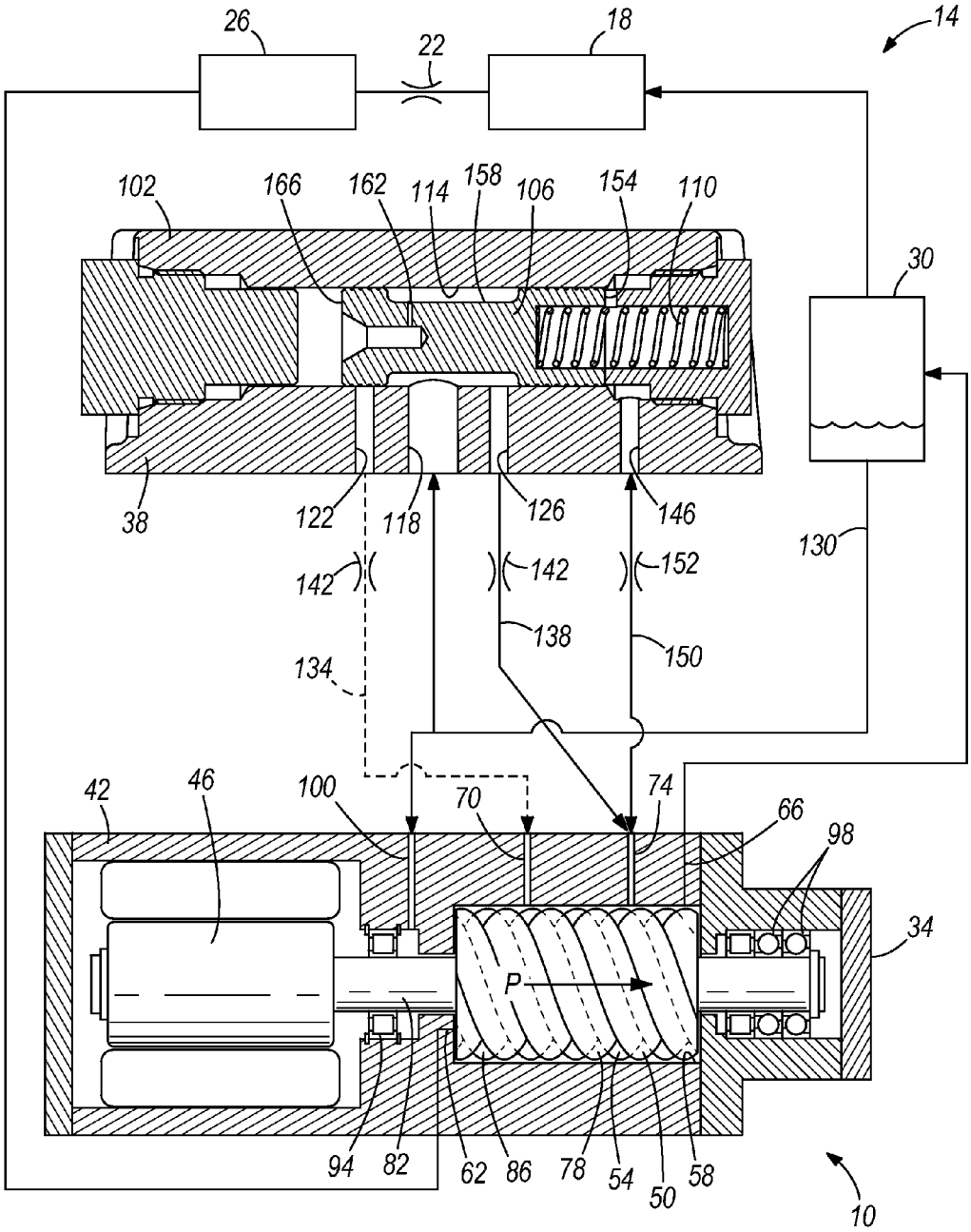
FIG. 2 is the schematic of the refrigeration system shown in FIG. 1 with the valve in a second position.

FIGS. 1 and 2 illustrate a compressor system 10 embodying the invention. In the illustrated embodiment, the compressor system 10 is part of a refrigeration system 14 that is operable to circulate refrigerant for cooling an area. Although the illustrated compressor system 10 is described for use with the refrigeration system 14, in other embodiments, the compressor system 10 may be part of other systems or processes that require a compressed fluid, such as, for example, natural gas applications or air-operated construction machinery.

In addition to the compressor system 10, the refrigeration system 14 includes a condenser 18, an expansion valve 22, and an evaporator 26. The compressor system 10 compresses a refrigerant and delivers the compressed refrigerant to the condenser 18. The condenser 18 receives the compressed refrigerant and removes heat from the refrigerant. The expansion valve 22 receives the refrigerant from the condenser 18 and directs the refrigerant to the evaporator 26. As the refrigerant passes through the expansion valve 22, the refrigerant decreases in pressure and temperature. The evaporator 26 receives the cool refrigerant from the expansion valve 22 and facilitates heat exchange between the refrigerant and a secondary fluid (e.g., air) or structure. The refrigerant is then circulated back to the compressor system 10 for compression.

In the illustrated embodiment, the compressor system 10 includes a lubricant reservoir 30, a screw compressor 34, and a control valve 38. The lubricant reservoir 30 is positioned between the condenser 18 and the screw compressor 34 to contain or store lubricant (e.g., oil) until needed. The lubricant reservoir 30 includes a separator to separate the lubricant from the refrigerant during operation of the refrigeration system 14. In some embodiments, the separator may be, for example, a centrifugal separator, a coalescing plate separator, or the like.

The illustrated screw compressor 34 includes a compressor housing 42, a motor 46, a drive rotor 50, and an idler rotor 54. Although the compressor 34 is illustrated and described as a screw compressor having two rotors 50, 54, in other embodiments, the compressor 34 may be a tri-rotor compressor, a gate rotor compressor, or the like. The compressor housing 42 defines a compression chamber 58 having a suction port 62, a discharge port 66, a first lubricant feed port 70 located between the suction port 62 and the discharge port 66, and a second lubricant feed port 74 located between the discharge port 66 and the first lubricant feed port 70. The suction port 62 is in fluid communication with the evaporator 26 to receive refrigerant from the evaporator 26 and direct the refrigerant into the compression chamber 58. The discharge port 66 is in communication with the lubricant reservoir 30 to deliver compressed refrigerant and lubricant from the compression chamber 58 to the reservoir 30.

In the illustrated embodiment, the motor 46 is positioned within the compressor housing 42 and coupled to the drive rotor 50. In other embodiments, the motor 46 may be positioned only partially within the compressor housing 42 or may be supported outside of the housing 42. The motor 46 drives (e.g., rotates) the drive rotor 50 to compress refrigerant, or other fluids, within the compression chamber 58 and move the refrigerant from the suction port 62 to the discharge port 66.

The drive rotor 50 and the idler rotor 54 are supported by the compressor housing 42 and disposed within the compression chamber 58. The illustrated drive rotor 50 includes a screw 78 and a shaft 82. The shaft 82 is coupled to the motor 46 for rotation by the motor 46. Similar to the drive rotor 50, the idler rotor 54 includes a screw 86 and a shaft (not shown). The screw 86 of the idler rotor 54 intermeshes with the screw 78 of the drive rotor 50 such that the drive rotor 50 drives the idler rotor 54 when the drive rotor 50 is rotated by the motor 46. As the drive rotor 50 and the idler rotor 54 rotate, the screws 78, 86 compress refrigerant within the compression chamber 58 and move the refrigerant in a direction of increasing pressure P from the suction port 62 to the discharge port 66.

The illustrated screw compressor 34 also includes bearings 94, 98 supporting the drive rotor 50 and the idler rotor 54. The bearings 94, 98 are supported within the compressor housing 42 and surround portions of the shafts 82 adjacent the suction port 62 and portions of the shafts 82 adjacent the discharge port 66. The bearings 94, 98 facilitate rotation of the rotors 50, 54 relative to the compressor housing 42. The illustrated compressor housing 42 defines a bearing feed port 100 to supply lubricant to the bearings 94 adjacent the suction port 62 during operation of the compressor system 10. In some embodiments, the compressor housing 42 may also define a bearing feed port to supply lubricant to the bearings 98 adjacent the discharge port 66.

The control valve 38 is positioned in fluid communication between the lubricant reservoir 30 and the screw compressor 34 to selectively direct lubricant from the reservoir 30 to the lubricant feed ports 70, 74. The illustrated valve 38 is movable between a first position (FIG. 1), in which lubricant is directed to the first lubricant feed port 70 of the compressor 34, and a second position (FIG. 2), in which lubricant is directed to the second lubricant feed port 74 of the compressor 34. The first lubricant feed port 70 is located at a relatively low volume ratio (VR) section of the compression chamber 58 (e.g., at a VR of about 1.1). The second lubricant feed port 74 is located at a higher VR section of the compression chamber 58 (e.g., at a VR greater than 2). The first and second lubricant feed ports 70, 74 are in communication with the lubricant reservoir 30 through the valve 38 to deliver lubricant from the reservoir 30 to the compression chamber 58.

In the illustrated embodiment, the valve 38 is a spool valve and includes a valve housing 102, a spool 106, and a biasing member 110. In other embodiments, other suitable types of valves may alternatively be employed. The valve housing 102 defines a cavity 114 that receives the spool 106, an inlet 118, and a plurality of outlets 122, 126. The inlet 118 is in communication with the lubricant reservoir 30 via an inlet passageway 130 to supply lubricant from the reservoir 30 to the cavity 114. The first outlet 122 is in communication with the first lubricant feed port 70 via a first lubricant feed passageway 134 to supply lubricant from the cavity 114 to the first lubricant feed port 70. The second outlet 126 is in communication with the second lubricant feed port 74 via a second lubricant feed passageway 138 to supply lubricant from the cavity 114 to the second lubricant feed port 74. In the illustrated embodiment, an orifice or restriction 142 is positioned in each passageway 134, 138 to limit fluid flow through the passageways 134, 138.

Figure 3:
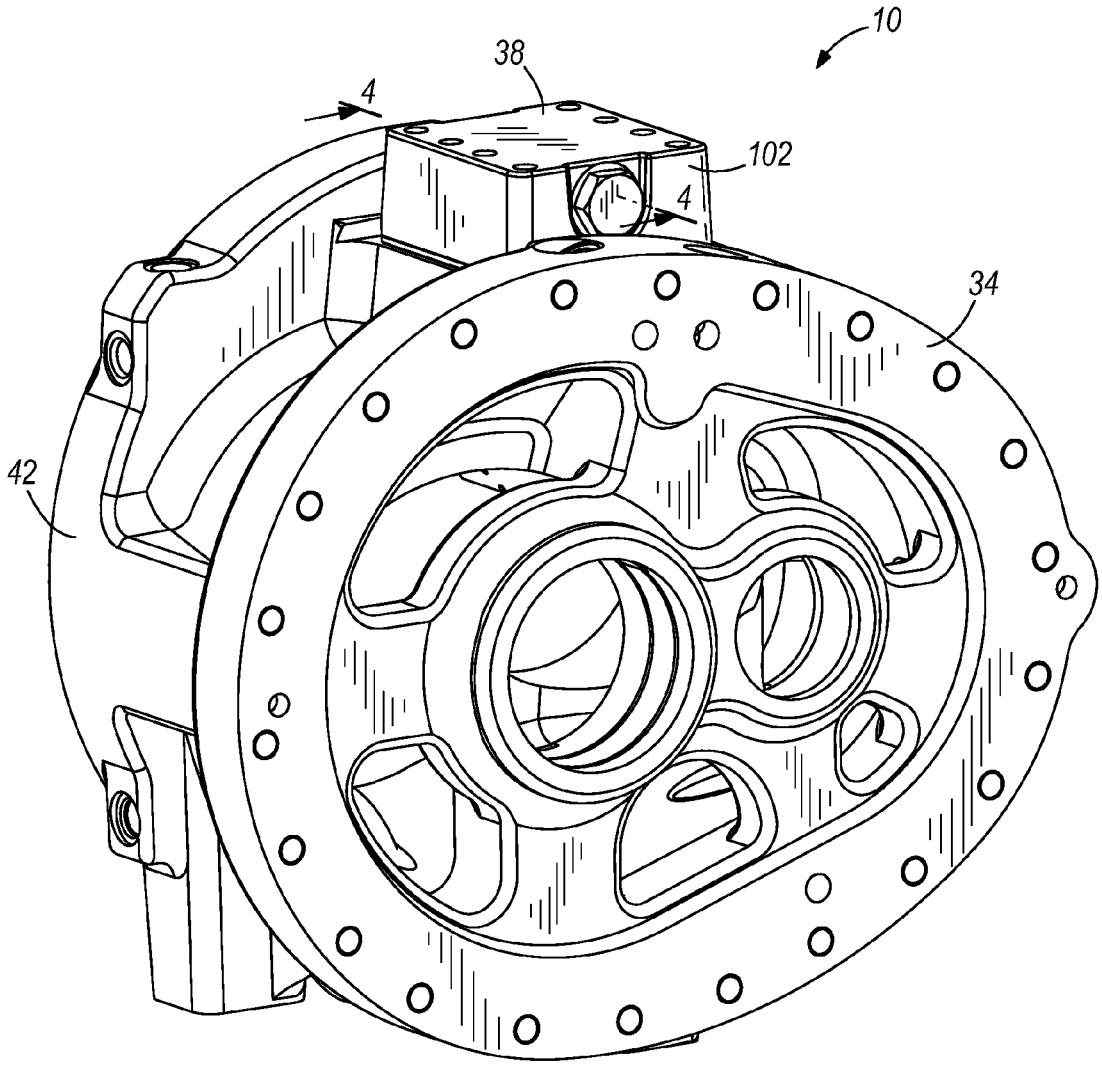
FIG. 3 is a perspective view of the compressor system.
Figure 4:
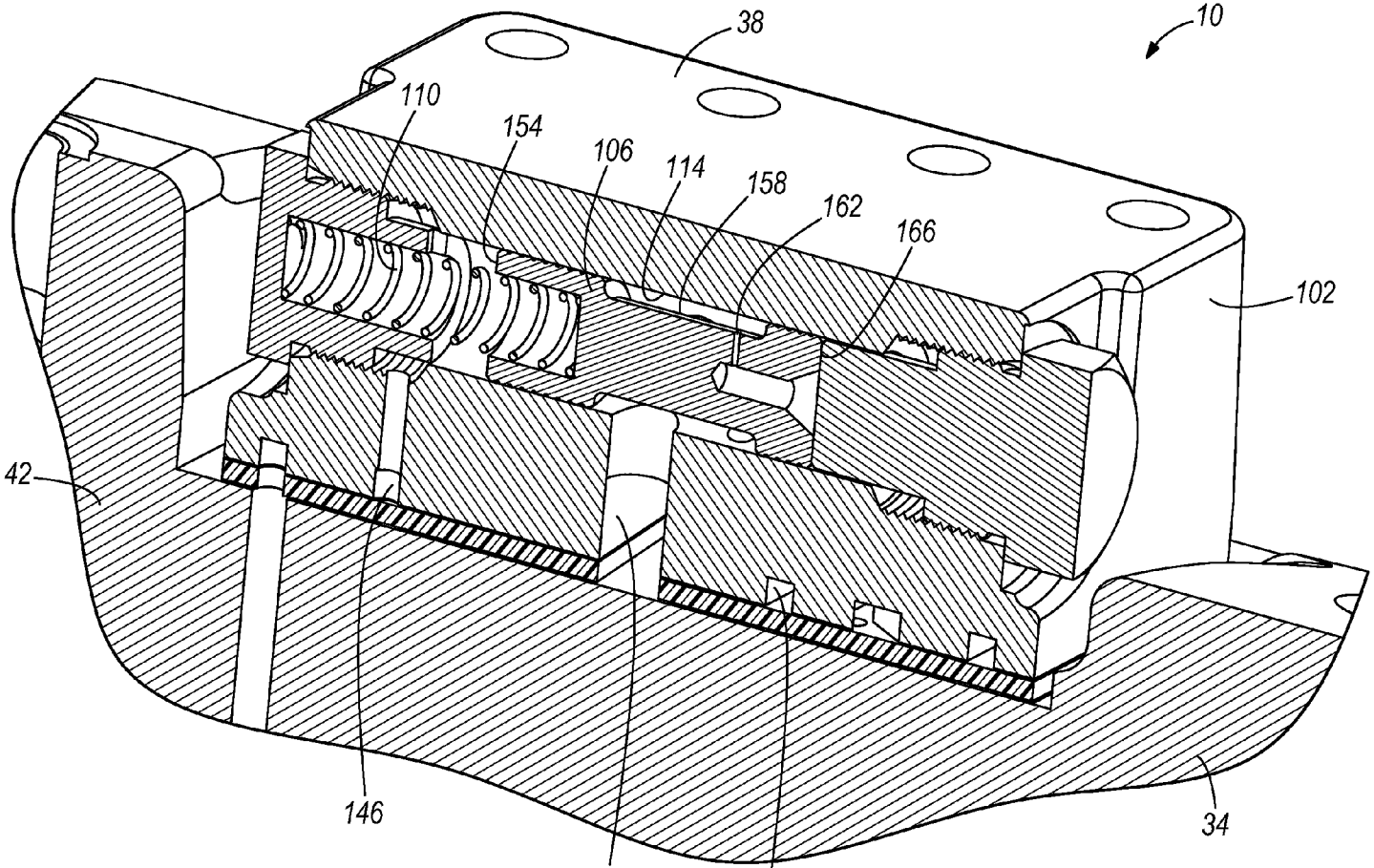
FIG. 4 is a cross-sectional view of a portion of the compressor system taken along section line 4-4 of FIG. 3.

FIGS. 3 and 4 illustrate the compressor housing 42 and the valve 38 in more detail. In the illustrated embodiment, the valve 38 is mounted (e.g., bolted, screwed, welded, etc.) directly to the compressor housing 42. In such embodiments, the lubricant feed passageways 134, 138 are direct connections formed by aligning the outlets 122, 126 in the valve housing 110 with the ports 70, 74 in the compressor housing 42. In other embodiments, the valve 38 may be coupled to, but spaced apart from the compressor housing 42. In such embodiments, the lubricant feed passageways 134, 138 may be separate conduits or lines that extend between the valve housing 110 and the compressor housing 42.

Referring back to FIGS. 1 and 2, the spool 106 is movable within the cavity 114 relative to the valve housing 102 to selectively open and close (e.g., unblock and block) the outlets 122, 126. As shown in FIG. 1, the spool 106 shuttles or slides to the first position to open the first outlet 122 and block the second outlet 126. In this position, the valve 38 fluidly connects the lubricant reservoir 30 to the first lubricant feed passageway 134 to direct lubricant to the first lubricant feed port 70. As shown in FIG. 2, the spool 106 shuttles or slides to the second position to open the second outlet 126 and block the first outlet 122. In this position, the valve 38 fluidly connects the lubricant reservoir 30 to the second lubricant feed passageway 138 to direct lubricant to the second lubricant feed port 74.

In the illustrated embodiment, the spool 106 is actuated between the first and second positions based on a difference in pressure between a pressure at a first pressure region and a pressure at a second pressure region. In the embodiment shown in FIGS. 1 and 2, the first pressure region includes the lubricant reservoir 30 and the second pressure region includes a portion of the compression chamber 58 adjacent the second lubricant feed port 74. The pressure in the lubricant reservoir 30 is substantially the same as the pressure at the discharge port 66 of the compressor 34. The spool 106 moves to the first position (FIG. 1) when the pressure in the compression chamber 58 adjacent the second lubricant feed port 74 is greater than or equal to the pressure in the lubricant reservoir 30 (i.e., when the pressure at the second pressure region is greater than or equal to the pressure at the first pressure region). The spool 106 moves to the second position (FIG. 2) when the pressure in the lubricant reservoir 30 is greater than the pressure in the compression chamber 58 adjacent the second lubricant feed port 74 (i.e., when the pressure at the first pressure region is greater than the pressure at the second pressure region).

As shown in FIGS. 1 and 2, the valve housing 102 also defines a pilot inlet 146 in fluid communication with the compression chamber 58 via a pilot passageway 150. An orifice or restriction 152 is positioned in the pilot passageway 150 to limit fluid flow through the passageway 150. In some embodiments, the orifice 152 may be omitted. Although the pilot passageway 150 is schematically shown as being in fluid communication with the compression chamber 58 through the second lubricant feed port 74, the pilot passageway 150 is actually in fluid communication with the compression chamber 58 through a separate port that is generally parallel to, but spaced apart from the second lubricant feed port 74. That is, the separate port is at the same relative distance from the suction port 62 in the direction of increasing pressure P as the second lubricant feed port 74, but offset transversely from the second lubricant feed port 74. In some embodiments, the pilot inlet 146 communicates with the second lubricant feed port 74. The pilot inlet 146 directs a signal pressure from the compression chamber 58 into the cavity 114. This signal pressure enters the cavity 114 adjacent a first end 154 of the spool 106 (on the right side of the spool 106 in FIGS. 1 and 2).

The illustrated spool 106 includes a recessed annular portion 158 and a bleed hole 162 extending from the recessed portion 158 to a central region of the spool 106. The recessed portion 158 allows lubricant to flow into the cavity 114 of the valve housing 102 through the inlet 118. The recessed portion 158 also allows lubricant to flow around the spool 106 to the outlets 122, 126 and the bleed hole 162. The bleed hole 162 directs the lubricant toward a second end 166 of the spool 106 (on the left side of the spool 106 in FIGS. 1 and 2).

The pilot inlet 146 and the bleed hole 162 thereby establish pressures at the first end 154 and the second end 166 of the spool 106, respectively. The pilot inlet 146 directs fluid toward the right side of the illustrated spool 106 such that the pressure at the first end 154 of the spool 106 is generally equal to the pressure in the compression chamber 58 adjacent the second lubricant feed port 74 (i.e., the pressure at the second pressure region). The bleed hole 162 directs fluid toward the left side of the illustrated spool 106 such that the pressure at the second end 166 of the spool 106 is generally equal to the pressure in the lubricant reservoir 30 (i.e., the pressure at the first pressure region). When the pressure at the first end 154 of the spool 106 exceeds the pressure at the second end 166 of the spool 106, the spool 106 shuttles or slides to the first position (FIG. 1). When the pressure at the second end 166 of the spool 106 exceeds the pressure at the first end 154 of the spool 106, the spool 106 shuttles or slides to the second position (FIG. 2).

The biasing member 110 is positioned within the valve housing 102 and coupled to the spool 106 to bias the spool 106 to the first position (to the left in FIGS. 1 and 2). In the illustrated embodiment, the biasing member 110 is a coil spring. In other embodiments, other suitable biasing members may also or alternatively be employed. The biasing member 110 inhibits premature movement of the spool 106 to the second position (FIG. 2) if the pressure in the lubricant reservoir 30 is equal to or only slightly higher than the pressure in the compression chamber 58. The biasing member 110 also prepositions the valve 38 in the first position (FIG. 1) at startup of the compression system 10.

In operation, the motor 46 drives the shaft 82 of the drive rotor 50 to rotate the drive rotor 50 and the idler rotor 54. Fluid (e.g., refrigerant) is directed from the evaporator 26 into the compression chamber 58 of the screw compressor 34 through the suction port 62 in the compressor housing 42. The fluid is compressed by the rotors 50, 54 and moved in the direction of increasing pressure P from the suction port 62 to the discharge port 66, creating progressively increased pressure in the compression chamber 58. The fluid continues through the compression chamber 58 to the discharge port 66. The discharge port 66 directs the compressed fluid (e.g., refrigerant and lubricant) from the screw compressor 34 to the lubricant reservoir 30.

At startup of the compressor system 10, the valve 38 is in the first position (FIG. 1) to direct lubricant (e.g., oil) from the lubricant reservoir 30 to the first lubricant feed port 70. In this position, relatively low pressure lubricant is delivered to a low pressure section of the compression chamber 58 to lubricate the rotors 50, 54. Such an arrangement facilitates supplying lubricant to the rotors 50, 54 when the pressure of the lubricant is less than the pressure in the chamber 58 at the second lubricant feed port 74. Otherwise, the lubricant may be blown back through the second lubricant feed port 74.

As the screw compressor 34 continues to operate, the pressure of the fluid being discharged through the discharge port 66 to the lubricant reservoir 30 increases, creating increased pressure in the reservoir 30. When the pressure in the lubricant reservoir 30 is greater than the pressure in the compression chamber 58 adjacent the second lubricant feed port 74 and the biasing force of the biasing member 110, the valve 38 moves to the second position (FIG. 2) to direct lubricant from the lubricant reservoir 30 to the second lubricant feed port 74. In this position, relatively high pressure lubricant is delivered to a higher pressure section of the compression chamber 58 to lubricate the rotors 50, 54. Such an arrangement increases efficiency of the compressor system 10 by supplying lubricant to the rotors 50, 54 at a location closer to the discharge port 66.

In some operating conditions of the screw compressor 34, the rotors 50, 54 may over-compress fluid in the compression chamber 58 such that the pressure in the chamber 58 is higher than the pressure of fluid being discharged to the reservoir 30. During such conditions, if the valve 38 remained in the second position (FIG. 2), lubricant from the reservoir 30 would be blown back through the second feed port 74 and would not reach the rotors 50, 54. However, the pilot inlet 146 directs high pressure fluid from the compression chamber 58 into the cavity 114 of the valve 38 to move the valve 38 back to the first position (FIG. 1) during these conditions. Lubricant is then directed from the lubricant reservoir 30 to the rotors 50, 54 through the first lubricant feed port 70, which is at a relatively lower pressure section of the compression chamber 58.

Figure 5:
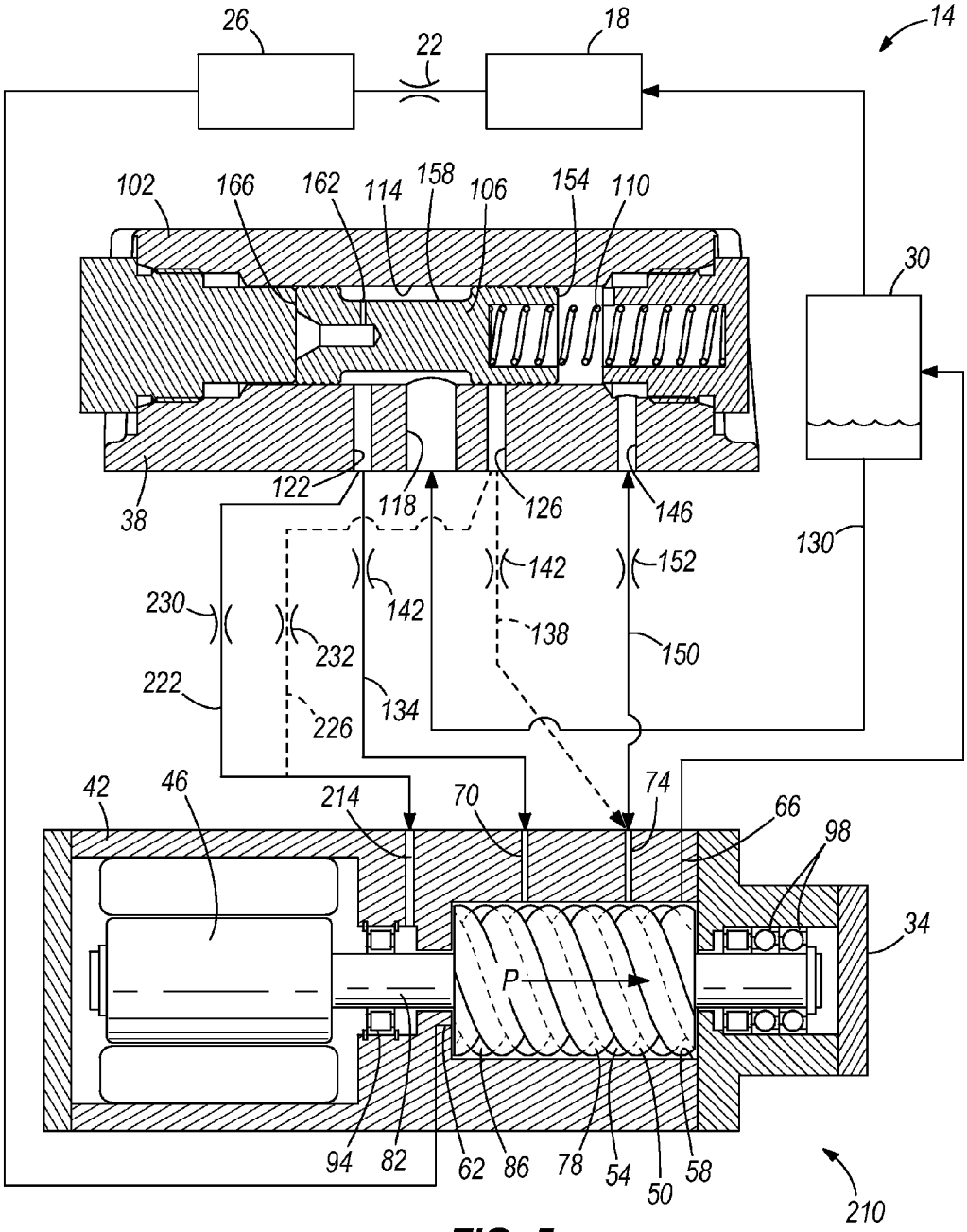
FIG. 5 is a schematic of a refrigeration system including another embodiment of a compressor system, the compressor system including a valve in a first position.
Figure 6:
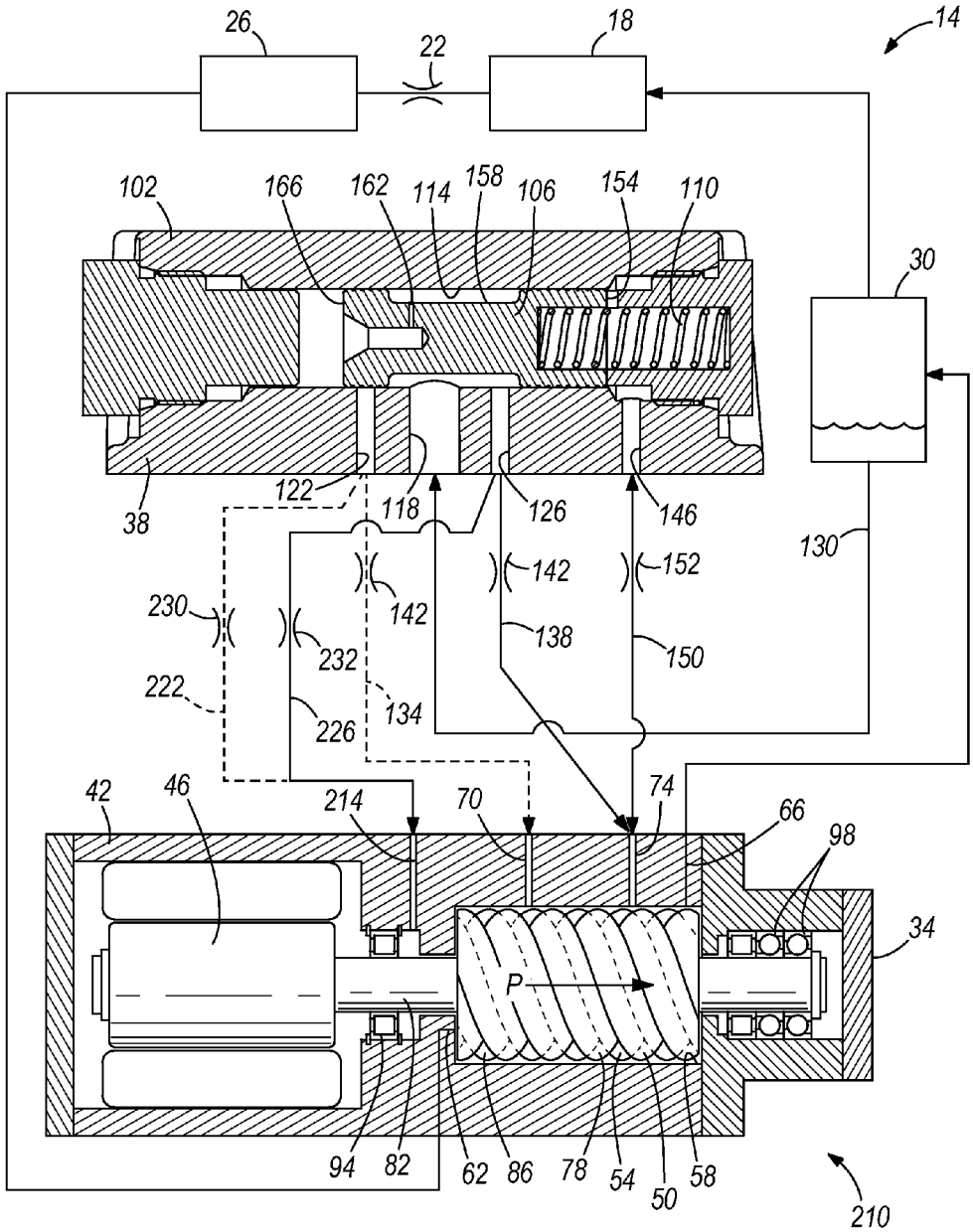
FIG. 6 is the schematic of the refrigeration system shown in FIG. 5 with the valve in a second position.

FIGS. 5 and 6 illustrate another embodiment of a compressor system 210 for use with the refrigeration system 14. The illustrated compressor system 210 is similar to the compressor system 10 discussed above and like parts have been given the same reference numbers. Reference is hereby made to the compressor system 10 of FIGS. 1-4 for discussion of features and elements of the compressor system 210, as well as alternatives to the features and elements, not specifically discussed below.

In the illustrated embodiment, the compressor housing 42 defines a bearing feed port 214. The bearing feed port 214 is in fluid communication with the bearings 94 adjacent the suction port 62. Although not shown, in some embodiments, the compressor housing 42 may also define a bearing feed port in communication with the bearings 98 adjacent the discharge port 66.

As shown in FIG. 5, the bearing feed port 214 is in fluid communication with the valve 38 via a third lubricant feed passageway 222 to deliver lubricant to the bearings 94 when the valve 38 is in the first position. As shown in FIG. 6, the bearing feed port 214 is in fluid communication with the valve 38 via a fourth lubricant feed passageway 226 to deliver lubricant to the bearings 94 when the valve 38 is in the second position. The lubricant feed passageways 222, 226 communicate with the cavity 114 of the valve 38 through outlets that are generally parallel to, but spaced apart from the first outlet 122 and the second outlet 126, respectively.

An orifice or restriction 230, 232 is positioned in each passageway 222, 226 to limit lubricant flow through the passageways 222, 226. The second orifice 232 has a smaller diameter than the first orifice 230 such that less lubricant is supplied to the bearings 94 when the valve 38 is in the second position than when the valve 38 is in the first position. Such an arrangement increases the efficiency of the compressor system 10. During startup, the bearings 94 are flooded with lubricant through the orifice 230 to ensure proper lubrication for rotation of the rotors 50, 54. As the screw compressor 34 continues to operate, a smaller volume of lubricant can be supplied to the bearings 94 to maintain proper lubrication of the bearings 94. The smaller diameter of the second orifice 232 directs less lubricant to the bearings 94 than the orifice 230, thereby increasing the efficiency of the system 10.

Figure 7:
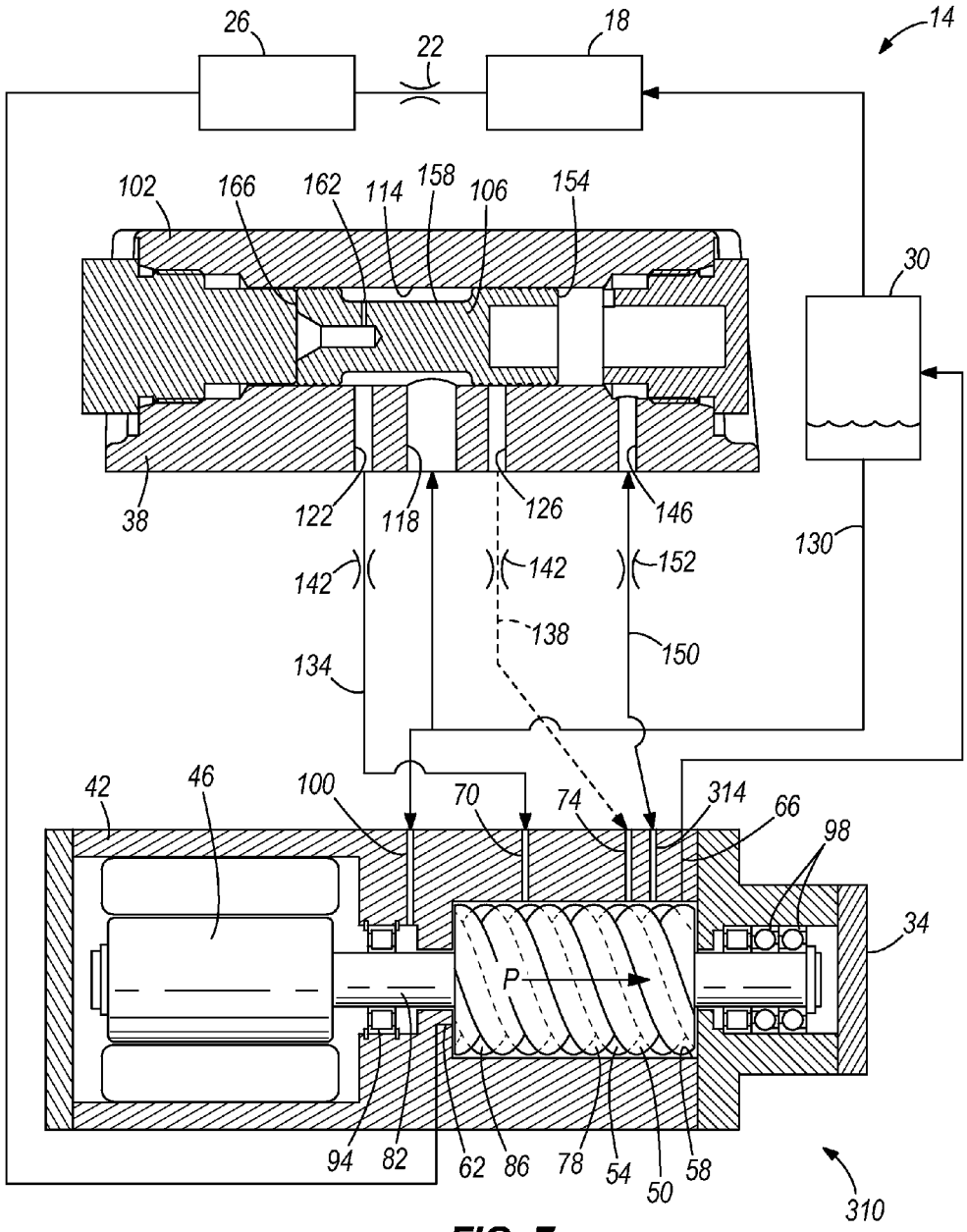
FIG. 7 is a schematic of a refrigeration system including yet another embodiment of a compressor system, the compressor system including a valve in a first position.
Figure 8:
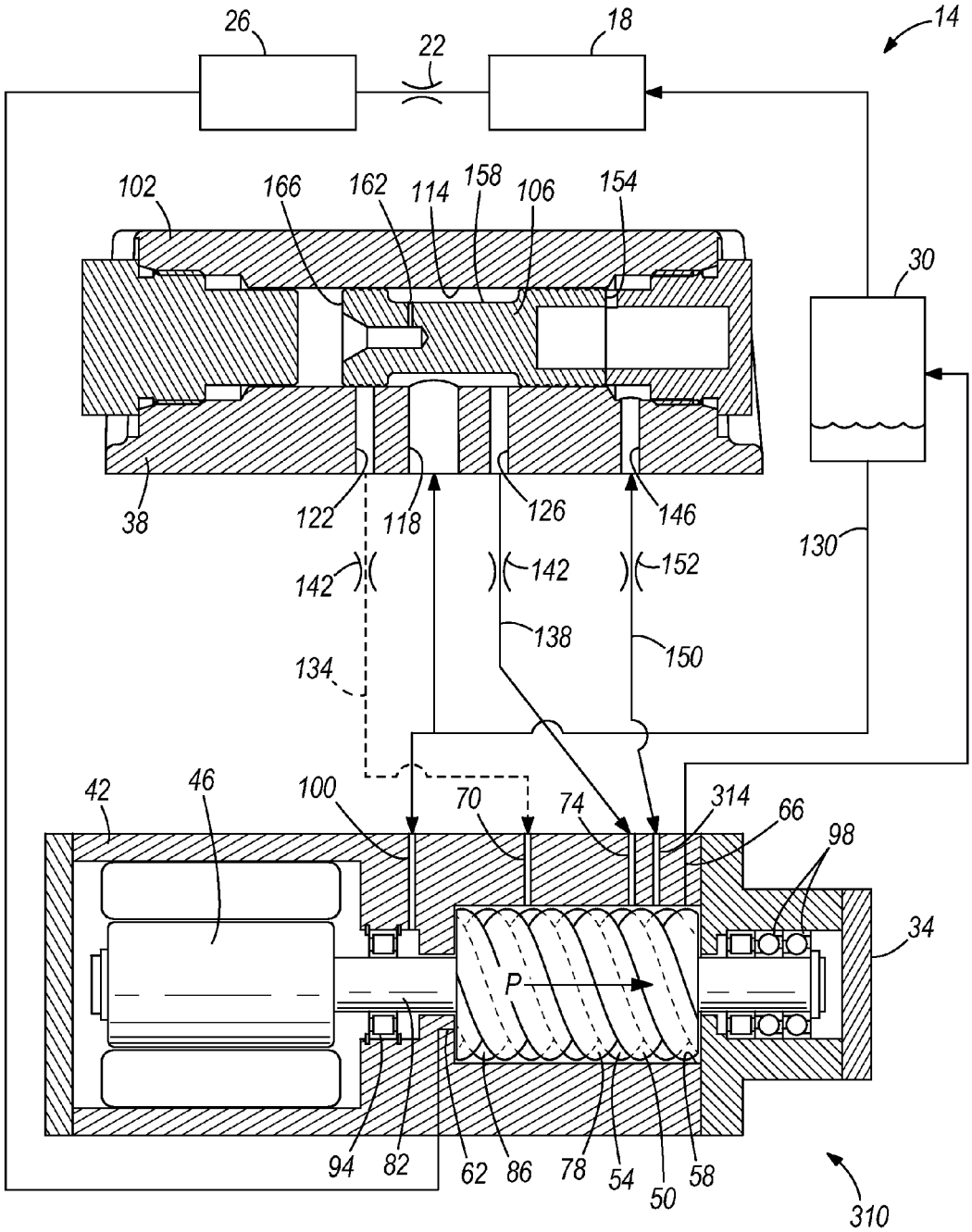
FIG. 8 is the schematic of the refrigeration system shown in FIG. 7 with the valve in a second position.

FIGS. 7 and 8 illustrate another embodiment of a compressor system 310 for use with the refrigeration system 14. The illustrated compressor system 310 is similar to the compressor system 10 discussed above and like parts have been given the same reference numbers. Reference is hereby made to the compressor system 10 of FIGS. 1-4 for discussion of features and elements of the compressor system 310, as well as alternatives to the features and elements, not specifically discussed below.

Similar to the compressor system 10 discussed above, the valve 38 in the illustrated compressor system 310 moves between a first position (FIG. 7) and a second position (FIG. 8) based on a difference in pressure between a first pressure region and a second pressure region. In the illustrated embodiment, the first pressure region includes the lubricant reservoir 30 and the second pressure region includes a portion of the compression chamber 58 downstream of the second lubricant feed port 74. The pilot inlet 146 of the valve 38 is in fluid communication with the compression chamber 58 of the screw compressor 34 through a port 314 located between the second lubricant feed port 74 and the discharge port 66. That is, the port 314 is located further along the compression chamber 58 than the second lubricant feed port 74 in the direction of increasing pressure P.

The illustrated valve 38 does not include a biasing member (e.g., the biasing member 110 shown in FIGS. 1 and 2) to bias the spool 106 to the first position (FIG. 7). Instead, by positioning the port 314 between the second lubricant feed port 74 and the discharge port 66, the shuttle 106 does not move to the second position (FIG. 8) until the pressure in the lubricant reservoir 30 is significantly greater than the pressure in the compression chamber 58 adjacent the second feed port 74. With such an arrangement, it is less likely that lubricant will be blown back through the second feed port 74 when the valve 38 is in the second position. In some embodiments, the valve 38 may still include a biasing member or other element to preposition the shuttle 106 in the first position.

Although not shown, the illustrated compressor system 310 may also include a bearing feed port similar to the bearing feed port 214 shown in FIGS. 5 and 6 and discussed above.

Figure 9:
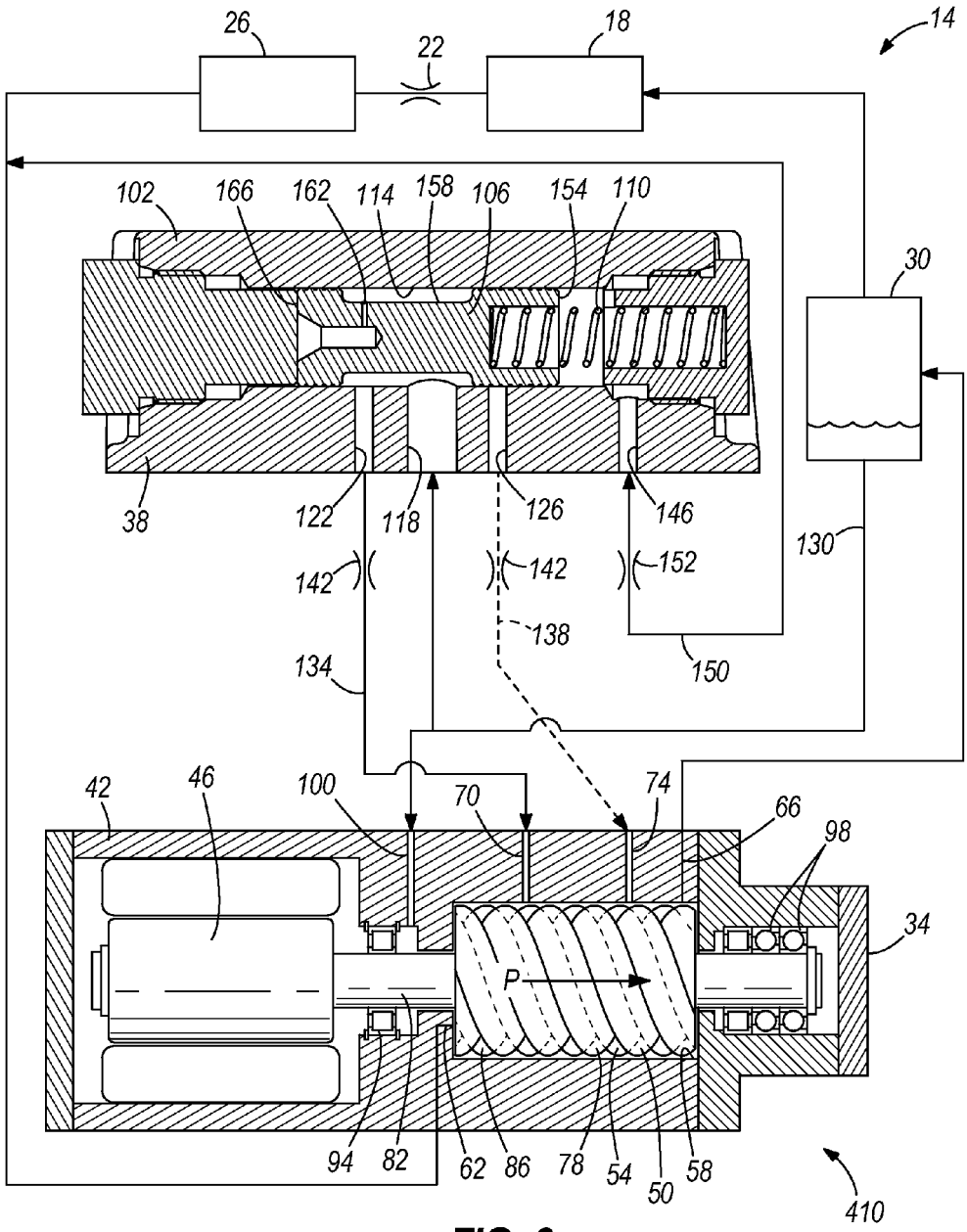
FIG. 9 is a schematic of a refrigeration system including still another embodiment of a compressor system, the compressor system including a valve in a first position.
Figure 10:
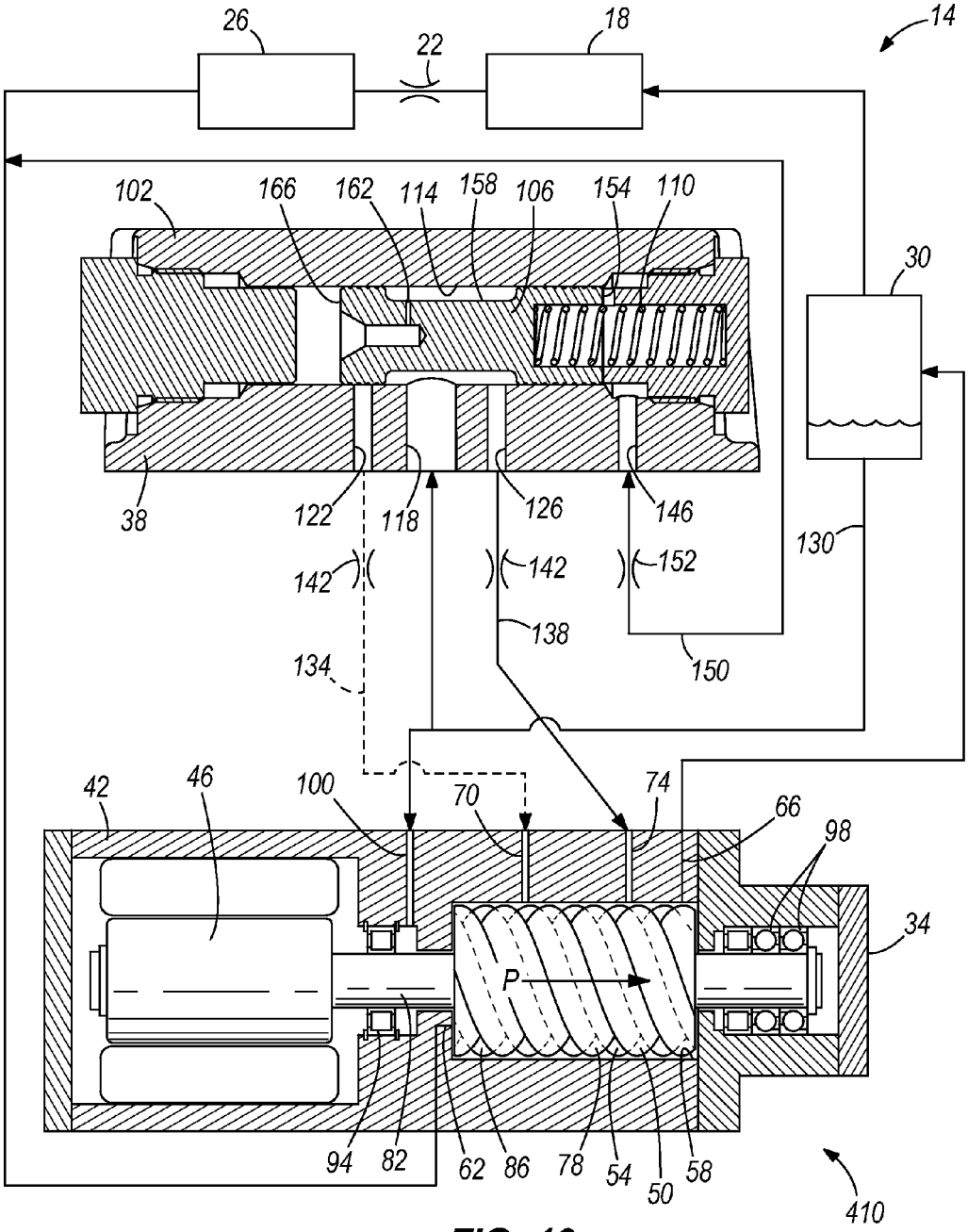
FIG. 10 is the schematic of the refrigeration system shown in FIG. 9 with the valve in a second position.

FIGS. 9 and 10 illustrate another embodiment of a compressor system 410 for use with the refrigeration system 14. The illustrated compressor system 410 is similar to the compressor system 10 discussed above and like parts have been given the same reference numbers. Reference is hereby made to the compressor system 10 of FIGS. 1-4 for discussion of features and elements of the compressor system 410, as well as alternatives to the features and elements, not specifically discussed below.

Similar to the compressor system 10 discussed above, the valve 38 in the illustrated compressor system 410 moves between a first position (FIG. 9) and a second position (FIG. 10) based on a difference in pressure between a first pressure region and a second pressure region. In the illustrated embodiment, the first pressure region includes the lubricant reservoir 30 and the second pressure region includes the suction port 62 of the compression chamber 58. With such an arrangement, the spool 106 moves to the first position (FIG. 9) when the pressure at the suction port 62 is greater than or equal to the pressure in the lubricant reservoir 30. The spool 106 moves to the second position (FIG. 10) when the pressure in the lubricant reservoir 30 is greater than the pressure at the suction port 62 and the force of the biasing member 110.

Although not shown, the illustrated compressor system 410 may also include a bearing feed port similar to the bearing feed port 214 shown in FIGS. 5 and 6 and discussed above.

Although the invention has been described in detail with reference to certain preferred embodiments, variations and modifications exist within the scope and spirit of one or more independent aspects of the invention. Various features of the invention are set forth in the following claims.

What is claimed is:

1. A compressor system comprising:

a lubricant reservoir adapted to contain a lubricant;

a screw compressor comprising a housing defining a compression chamber having a suction port, a discharge port, a first lubricant feed port located between the suction port and the discharge port, and a second lubricant feed port located between the discharge port and the first lubricant feed port, a drive rotor supported by the housing and disposed within the compression chamber, and an idler rotor supported by the housing and disposed within the compression chamber, the idler rotor driven by the drive rotor to compress and move fluid in a direction of increasing pressure from the suction port to the discharge port creating a pressure at a first pressure region; and a valve in fluid communication with the lubricant reservoir, the first lubricant feed port via a first lubricant feed passageway, and the second lubricant feed port via a second lubricant feed passageway, the valve movable between a first position and a second position based on the pressure at the first pressure region;

wherein, in the first position, the valve fluidly connects the lubricant reservoir to the first lubricant feed passageway to direct lubricant to the first lubricant feed port, and, in the second position, the valve fluidly connects the lubricant reservoir to the second lubricant feed passageway to direct lubricant to the second lubricant feed port.

2. The compressor system of claim 1, wherein operating the screw compressor increases the pressure at the first pressure region, and wherein increased pressure at the first pressure region moves the valve from the first position to the second position.

3. The compressor system of claim 2, wherein the valve includes a biasing member to bias the valve to the first position, and wherein the increased pressure at the first pressure region overcomes the biasing member to move the valve to the second position.

4. The compressor system of claim 1, wherein the valve includes a spool valve, and wherein the pressure at the first pressure region mechanically actuates the spool valve between the first position and the second position.

5. The compressor system of claim 1, wherein the idler rotor is driven by the drive rotor to also create a pressure at a second pressure region that is spaced apart from the first pressure region, and wherein the valve is moved between the first position and the second position based on a difference in pressure between the pressure at the first pressure region and the pressure at the second pressure region.

6. The compressor system of claim 5, wherein the first pressure region includes the lubricant reservoir and the second pressure region includes a portion of the compression chamber adjacent the second lubricant feed port.

7. The compressor system of claim 6, wherein the valve is moved to the first position when the pressure at the portion of the compression chamber is greater than the pressure at the lubricant reservoir, and wherein the valve is moved to the second position when the pressure at the lubricant reservoir is greater than the pressure at the portion of the compression chamber.

8. The compressor system of claim 5, wherein the first pressure region includes the lubricant reservoir and the second pressure region includes a portion of the compression chamber between the second lubricant feed port and the discharge port.

9. The compressor system of claim 8, wherein the valve is moved to the first position when the pressure at the portion of the compression chamber is greater than the pressure at the lubricant reservoir, and wherein the valve is moved to the second position when the pressure at the lubricant reservoir is greater than the pressure at the portion of the compression chamber.

10. The compressor system of claim 5, wherein the first pressure region includes the lubricant reservoir and the second pressure region includes the suction port of the compression chamber.

11. The compressor system of claim 10, wherein the valve is moved to the first position when the pressure at the suction port is greater than the pressure at the lubricant reservoir, and wherein the valve is moved to the second position when the pressure at the lubricant reservoir is greater than the pressure at the suction port.

12. The compressor system of claim 1, wherein the screw compressor includes a bearing supporting one of the drive rotor and the idler rotor for rotation, wherein the housing supports the bearing and defines a bearing feed port in fluid communication with the valve through a third lubricant feed passageway, and wherein the valve fluidly connects the lubricant reservoir to the third lubricant feed passageway to direct lubricant to the bearing feed port.

13. The compressor system of claim 12, wherein, in the first position, the valve fluidly connects the lubricant reservoir to the third lubricant feed passageway to direct lubricant to the bearing feed port, and, in the second position, the valve fluidly connects the lubricant reservoir to a fourth lubricant feed passageway to direct lubricant to the bearing feed port, wherein the third lubricant feed passageway includes a first orifice and the fourth lubricant feed passageway includes a second orifice, and wherein the second orifice has a smaller diameter than the first orifice such that less lubricant is supplied to the bearing when the valve is in the second position than when the valve is in the first position.

14. A method of operating a compressor system, the compressor system including a lubricant reservoir adapted to contain a lubricant and a screw compressor, the screw compressor comprising a housing defining a compression chamber having a suction port, a discharge port, a first lubricant feed port located between the suction port and the discharge port, and a second lubricant feed port located between the discharge port and the first lubricant feed port, the method comprising:

providing a valve in fluid communication with the lubricant reservoir, the first lubricant feed port via a first lubricant feed passageway, and the second lubricant feed port via a second lubricant feed passageway;

compressing and moving fluid in a direction of increasing pressure from the suction port to the discharge port creating a pressure at a first pressure region;

moving the valve between a first position and a second position based on the pressure at the first pressure region;

fluidly connecting the lubricant reservoir to the first lubricant feed passageway when the valve is in the first position to direct lubricant to the first lubricant feed port of the screw compressor; and fluidly connecting the lubricant reservoir to the second lubricant feed passageway when the valve is in the second position to direct lubricant to the second lubricant feed port of the screw compressor.

15. The method of claim 14, further comprising increasing the pressure at the first pressure region to move the valve from the first position to the second position.

16. The method of claim 15, further comprising biasing the valve to the first position with a biasing member, and wherein increasing the pressure at the first pressure region includes increasing the pressure at the first pressure region to overcome the biasing member and move the valve from the first position to the second position.

17. The method of claim 14, wherein providing the valve includes providing a spool valve, and wherein moving the valve includes mechanically actuating the spool valve between the first position and the second position based on the pressure at the first pressure region.

18. The method of claim 14, wherein compressing and moving fluid includes compressing and moving fluid in the direction of increasing pressure from the suction port to the discharge port creating the pressure at the first pressure region and a pressure at a second pressure region that is spaced apart from the first pressure region, and wherein moving the valve includes moving the valve between the first position and the second position based on a difference in pressure between the pressure at the first pressure region and the pressure at the second pressure region.

19. The method of claim 14, wherein the screw compressor includes a bearing, wherein the housing supports the bearing and defines a bearing feed port, wherein providing the valve includes providing the valve in fluid communication with the bearing feed port via a third lubricant feed passageway, and further comprising:

fluidly connecting the lubricant reservoir to the third lubricant feed passageway to direct lubricant to the bearing feed port.

20. The method of claim 19, wherein providing the valve also includes providing the valve in fluid communication with the bearing feed port via a fourth lubricant feed passageway, wherein the third lubricant feed passageway includes a first orifice and the second lubricant feed passageway includes a second orifice, and further comprising:

fluidly connecting the lubricant reservoir to the fourth lubricant feed passageway when the valve is in the second position to direct lubricant to the bearing feed port, wherein the second orifice has a smaller diameter than the first orifice such that less lubricant is supplied to the bearing when the valve is in the second position than when the valve is in the first position.

* * * * *